US007103521B2

(12) United States Patent
Duret et al.

(10) Patent No.: US 7,103,521 B2
(45) Date of Patent: Sep. 5, 2006

(54) METHOD AND DEVICE FOR NEUTRALIZING, BY CONTROLLED GAS INJECTION, THE FORMATION OF LIQUID SLUGS AT THE FOOT OF A RISER CONNECTED TO A MULTIPHASE FLUID TRANSPORT PIPE

(75) Inventors: Emmanuel Duret, Rueil Malmaison (FR); Quang-Huy Tran, Rueil Malmaison (FR)

(73) Assignee: Institut Francais Du Petrole, Rueil Malmaison Cedex (FR)

( * ) Notice: Subject to any disclaimer, the term of this patent is extended or adjusted under 35 U.S.C. 154(b) by 899 days.

(21) Appl. No.: 10/099,969

(22) Filed: Mar. 19, 2002

(65) Prior Publication Data

US 2002/0193976 A1 Dec. 19, 2002

(30) Foreign Application Priority Data

Mar. 19, 2001 (FR) ..... 01 03727

(51) Int. Cl.
*G06G 7/48* (2006.01)

(52) U.S. Cl. ..... 703/10; 261/96; 175/25

(58) Field of Classification Search ..... 703/9, 703/10; 261/96; 175/25, 38; 166/260.15, 166/250.15

See application file for complete search history.

(56) References Cited

U.S. PATENT DOCUMENTS 4,227,872 A * 10/1980 Zink et al. ..... 431/90
6,158,508 A * 12/2000 Lemetayer et al. .... 166/250.15
6,349,536 B1 * 2/2002 Fujioka ..... 60/775
6,367,566 B1 * 4/2002 Hill ..... 175/57
6,668,943 B1 * 12/2003 Maus et al. ..... 175/5

FOREIGN PATENT DOCUMENTS

| | | |
|---|---|---|
| EP | 0756065 | 1/1997 |
| EP | 1022429 | 7/2000 |
| WO | 0000715 | 1/2000 |
| WO | 0075477 | 12/2000 |

OTHER PUBLICATIONS

XP-002183157 "Methods For Eliminating Pipeline-Riser Flow Instabilities" F.E. Jansen and Ovadia Shoham, U. Of Tulsa, SPE Members23-25, Mar. 1994.
XP-002183156 "Simulation of Process To Control Severe Slugging: Application To The Dunbar Pipeline" V. Henriot et al, Society of Petroleum Engineers, Inc. Oct. 3-6, 19993.

* cited by examiner

*Primary Examiner*—Albert W. Paladini
(74) *Attorney, Agent, or Firm*—Antonelli, Terry, Stout and Kraus, LLP.

(57) ABSTRACT

Method and device for neutralizing, by controlled gas injection, the formation of liquid slugs at the foot of a pipe portion greatly inclined to the horizontal or riser connected to a pipe carrying circulating multiphase fluids such as hydrocarbons.

Flow rate control is essentially obtained by injecting, at the base of the riser, a volume of gas proportional to the flow rate variation with time of the gas phase of the circulating fluids, and preferably substantially equal thereto, when this variation is positive. This action can be completed by modulating the injected gas flow by a quantity proportional to the flow rate variation of the liquid phase of the circulating fluids.

Applications: offshore hydrocarbon production control for example.

10 Claims, 9 Drawing Sheets

METHOD AND DEVICE FOR NEUTRALIZING, BY CONTROLLED GAS INJECTION, THE FORMATION OF LIQUID SLUGS AT THE FOOT OF A RISER CONNECTED TO A MULTIPHASE FLUID TRANSPORT PIPE

FIELD OF THE INVENTION

The present invention relates to a method and to a device for neutralizing, by controlled gas injection, liquid slugs or accumulations at the foot of a pipe portion greatly inclined to the horizontal or riser connected to a pipe carrying circulating multiphase fluids such as hydrocarbons.

BACKGROUND OF THE INVENTION

In order to make deep-sea reservoirs or marginal fields sufficiently cost-effective, oil companies have to develop new development techniques, as economical as possible. It is thus more advantageous to directly transport the two-phase mixture consisting of liquid (oil and a little water) and gas in a single pipe or pipeline to onshore facilities in order to be separated. A pipe portion greatly inclined to the horizontal (often close to the vertical), referred to as riser by specialists, which is connected to the deep-sea pipe, is used therefore. However, the gas and the liquid being transported together, flow instability phenomena may occur in the zone of connection with the riser, which lead to serious development problems.

In particular, when the gas and liquid inflow rates are low, the liquid phase accumulates in the lower parts of the pipeline and stops the gas flowing past. The upstream pressure increases and eventually expels the liquid slug to another low part or even in the phase separator at the outlet. These accumulation phenomena can reduce the productivity and fill pipes designed to receive gas with liquid. One of these phenomena, commonly referred to as severe slugging by specialists, has formed the subject of many studies, either experimental by means of test loops, or by simulation by means of simulation softwares such as, for example, the TACITE simulation code which is notably the object of the following patents or patent applications: U.S. Pat. No. 5,550,761, FR-2,756,044 (U.S. Pat. No. 6,028,992) and FR-2,756,045 (U.S. Pat. No. 5,960,187), FR-00/08,200 and FR-00/09,889 filed by the applicant.

This slugging phenomenon is described hereafter in the simple case illustrated in the accompanying figures where a pipe of low inclination and a riser ended by a separator designed to separate the liquid phase from the gas phase are considered.

The liquid accumulates in the lower part of the pipe and tends to stop the gas flowing past. The gas is compressed until the upstream pressure exceeds the pressure due to the weight of the accumulated liquid. A long liquid slug is then pushed by the expanding gas. Under such conditions, an alternating phenomenon is observed, where the liquid blocks the gas phase, then flows off under the pressure of the gas and eventually accumulates and blocks the gas again.

More precisely, the periodic process takes place as follows:

Stage I: the liquid accumulates at the foot of the riser and stops the gas flowing past. The pressure rises;

Stage II: the upper level of the liquid having reached the top of the riser, the liquid phase flows into the separator;

Stage III: the gas pocket reaches the foot of the riser and flows into the riser. The slug flows into the separator with a much higher velocity; the gas pocket <<explodes>> in the riser;

Stage IV: when the gas pocket reaches the top of the riser, the pressure at the foot of the pipe has a minimum value. The liquid falls down along the wall of the riser. It accumulates again at the foot of the riser and a new cycle starts.

A well-known technique referred to as gas lift by specialists allows to overcome this phenomenon. It essentially consists in permanently injecting gas at the base of the riser to prevent the accumulation of liquid at the bottom of the pipe. Since this phenomenon cannot be really controlled, most of the time one is led to inject large amounts of gas, which requires considerable compression means. Furthermore, injection of large amounts of gas substantially modifies the gas-oil ratio (GOR), which complicates the phase separation operations at the top of the riser.

SUMMARY OF THE INVENTION

The object of the method according to the invention is to exercise, by modelling the instability phenomena described above, an efficient dynamic control over the pressure of the gas to be injected into pipes so as to reduce these phenomena as much as possible.

The method according to the invention allows to neutralize, by controlled gas injection, the formation of liquid slugs or accumulations at the foot of a pipe portion greatly inclined to the horizontal or riser connected to a pipe carrying circulating multiphase fluids. This control is essentially exerted by injecting at the base of the riser a volume of gas substantially proportional to the mass flow rate variation with time of the gas phase of the circulating fluids, and preferably substantially equal thereto, when this variation is positive.

According to another implementation mode, control is exercised by modulating also the volume of gas injected by a quantity proportional to the mass flow rate variation of the liquid phase of the circulating fluids, also measured with the same time interval.

Injection is carried out at any time t, from the mass flow rate variation with time of the gas phase of the circulating fluid, measured at a previous time interval The implementing device allows to neutralize, by controlled gas injection, the formation of liquid slugs or accumulations at the foot of a pipe portion greatly inclined to the horizontal or riser connected to a pipe carrying circulating multiphase fluids. It comprises gas injection means connected to the base of the riser, means for measuring the flow rate of the gas phase of the circulating fluids, and a computer designed to control the injection, by the injection means, of a volume of gas substantially proportional to the flow rate variation with time of the gas phase of the circulating fluids, when this variation is positive.

The computer is for example suited to control the injection, by the injection means, of a volume of gas substantially equal to the flow rate variation with time of the gas phase of the circulating fluids.

According to an embodiment, the device also comprises means for measuring the flow rate of the liquid phase circulating in the pipe, the computer being suited to modulate the volume of gas injected by a quantity proportional to the measured flow rate variation of the liquid phase.

DETAILED DESCRIPTION

I-1 Modelling

Figure 1:
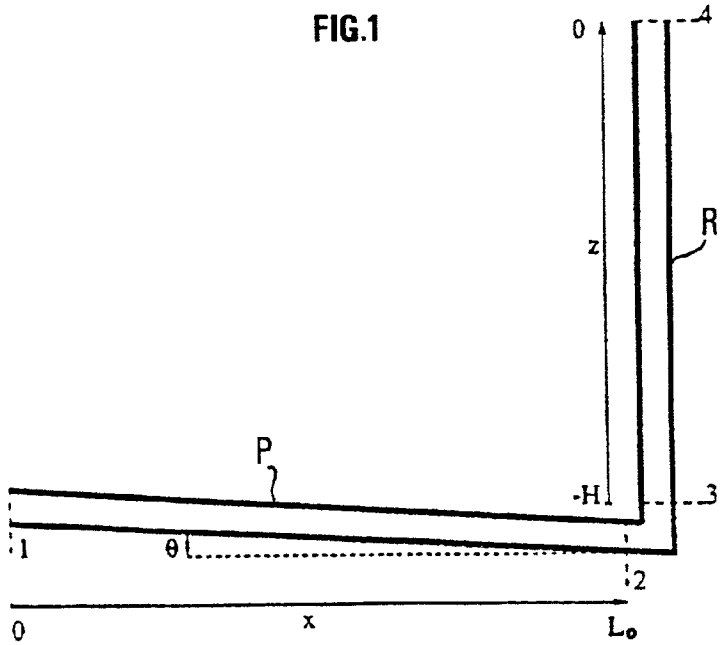
FIG. 1 diagrammatically shows a pipeline of low inclination connected to a riser greatly inclined to the horizontal, FIG. 2 diagrammatically shows a steady flow with continuous penetration of gas in a gas-liquid separator at the upper end of a riser, FIG. 3 diagrammatically shows the formation of a liquid slug at the foot of the riser.
Figure 2:
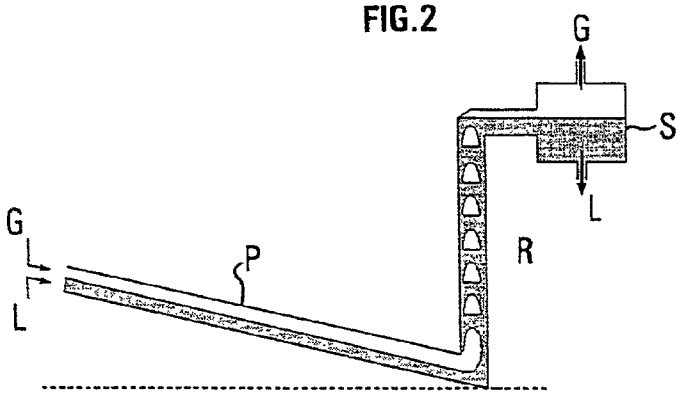
Figure 3:
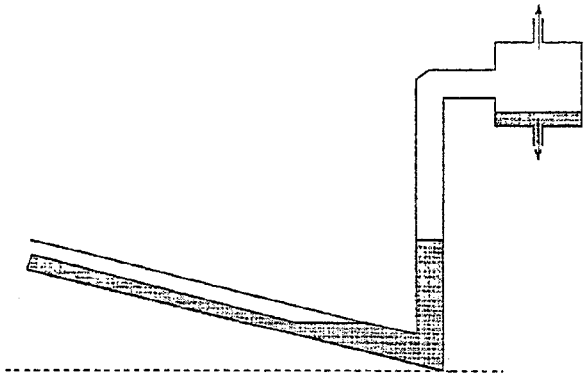
Figure 4:
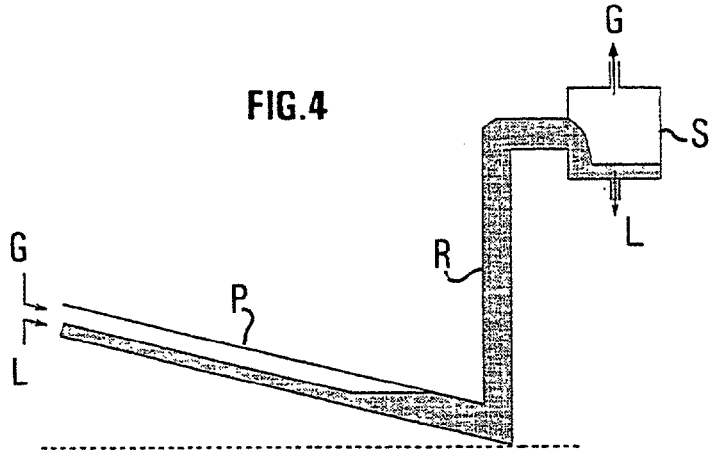
FIG. 4 shows the stage when the liquid slug reaches the separator at the top of the riser, FIG. 5 diagrammatically shows the gas pocket getting into the liquid accumulated in the riser.
Figure 5:
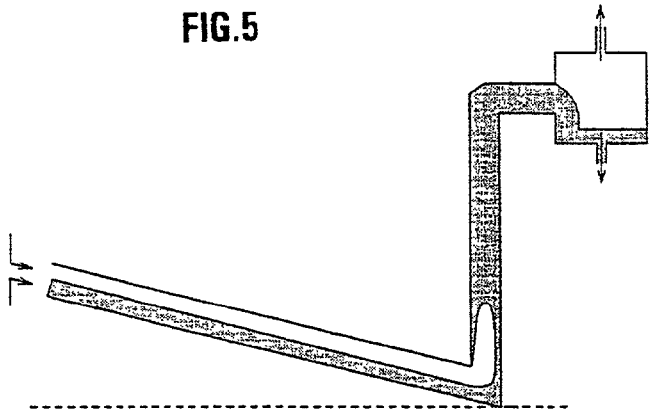
Figure 6:
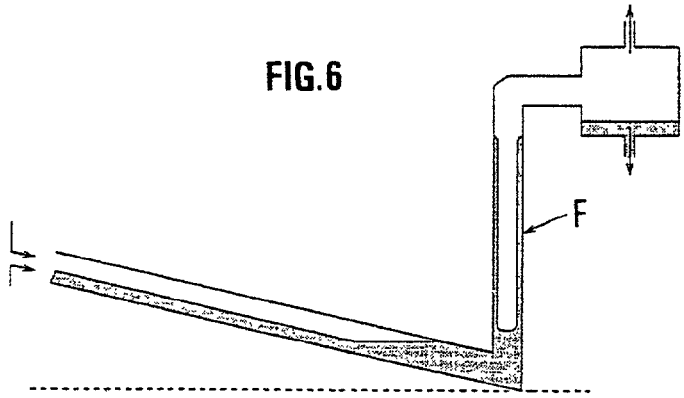
FIG. 6 shows the stage when the liquid falls back to the base of the riser.
Figure 7:
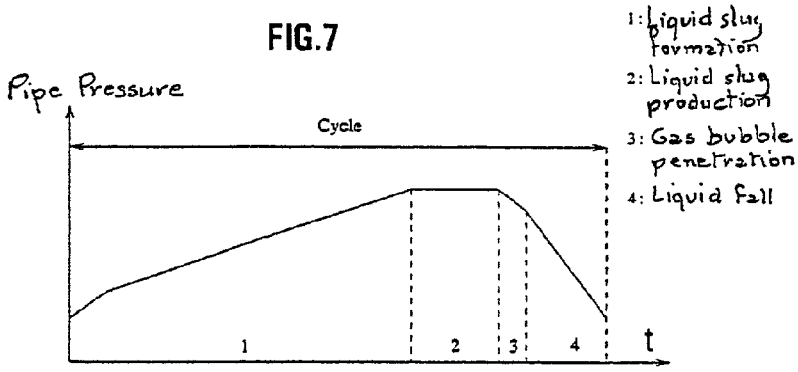
FIG. 7 shows the pressure curve in the pipeline at the foot of the riser during the previous cycle, FIGS. 8A to 8E diagrammatically and respectively show, in a riser, a flow mode referred to as bubble flow (8A), a flow mode referred to as intermittent flow (8B), a flow mode referred to as churn flow (8C), a flow mode referred to as annular flow (8D) and a flow mode referred to as stranded annular flow (8E), FIGS. 9A to 9G diagrammatically and respectively show, in a pipeline, a flow mode referred to as stratified flow (9A), a flow mode referred to as wavy stratified flow (9B), a flow mode referred to as droplet annular flow (9C), a flow mode referred to as dispersed bubble flow (9D), a flow mode referred to as intermittent flow (9E), a flow mode referred to as small-pocket flow (9F), and a flow mode referred to as elongated-bubble flow (9G)
Figures 8A, 8B, 8C, 8D, 8E:
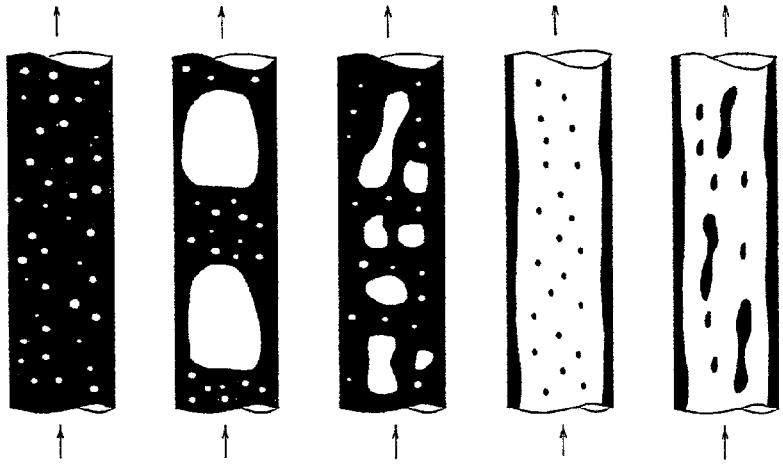
Figures 9A, 9B, 9C, 9D, 9E, 9F, 9G:
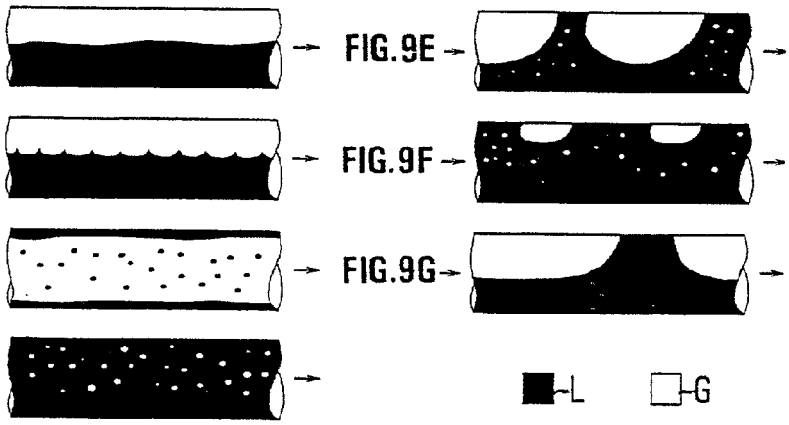
Figure 10:
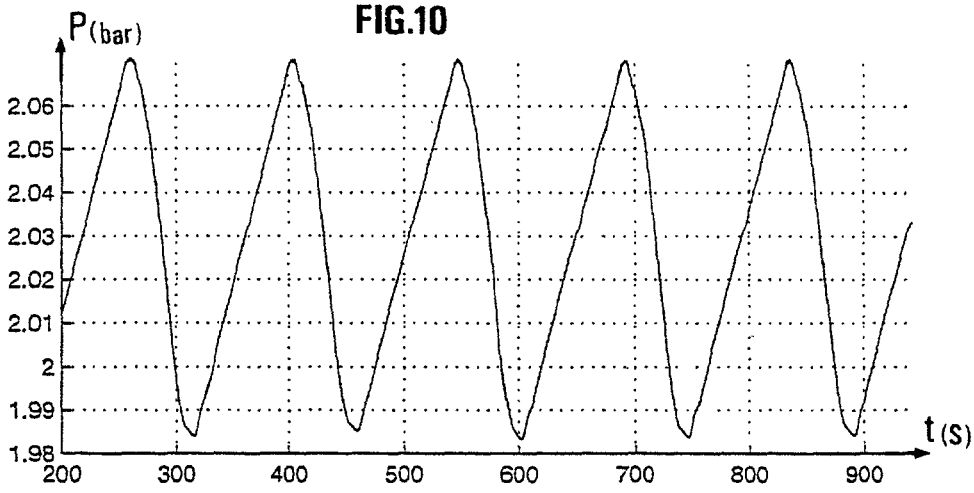
FIG. 10 shows an example of evolution of the pressure at the foot of a 14-m high riser, without any control by gas injection, FIGS. 11A, 11B respectively show the flow rate variations of liquid and gas at the riser outlet, also without control, FIGS. 12 and 13A, 13B correspond to FIGS. 10 and 11A, 11B for a 250-m high riser.

Modelling of the flow phenomena in the system consisting of the pipe and of the riser of FIG. 1 is obtained by means of the following hypotheses.

We choose a one-dimensional approximation where we consider the averages of the various quantities on a (straight) cross-section of the pipeline or of the riser. Since this approximation is acceptable only if the radius of curvature of the pipeline is assumed to be infinite and its diameter constant, the modelling procedure will concern the parts on either side of the connecting elbow.

We use a drift flow type modelling procedure with a mass conservation equation per phase and wherein the liquid and gas momentum conservation equations are added to one another so as to have a single equation referred to as mixture momentum conservation equation. To close the system, we choose a relation expressing a friction law between the phases.

We also conventionally assume that: the flow is isothermal, the fluids are Newtonian, the gas is a perfect gas, the liquid is incompressible (its density is therefore constant) and there is no mass transfer between the two phases.

We consider that the Mach number of the mixture is small so that the pressure waves are propagated at an infinite velocity instead of a velocity close to the sound velocity in the mixture. High-frequency phenomena are suppressed but the void fraction waves continue to be propagated at a velocity close to the velocity of the mixture. This hypothesis is reinforced by the fact that we study the system <<in transition >>to the state of obstruction or disturbed state, i.e. close to the steady state. This hypothesis is translated in the model into the absence of inertia terms in the momentum conservation equation.

I-2 Selection of the Fundamental Quantities

The following quantities are defined:

$R_G$ and $R_L$ are the volume fractions of gas and of liquid in the pipes.

$q_G$ and $q_L$ are the mass flow rates of gas and of liquid per section unit.

$V_G$ and $V_L$ are the velocities of the gas and of the liquid.

$\rho_G$ and $\rho_L$ are the densities of the gas and of the liquid.

P is the mean pressure of the mixture.

All these quantities are functions of R×R (space and time), zero on $R \times R_{31}{}^*$ and continuous on $R \times R_+{}^*$. According to the context, it is essential to always precisely say if the pipe concerned is the pipeline or the riser. Thus, we work on the pipeline in [0,L]×R by writing the variables (x,t) and on the riser in [−H,0]×R by writing the variables (z,t).

However, if an equation is valid in the pipeline as well as in the riser, the equation will be formally written with the variables $(x,t) \in [-H,L] \cup R_+$.

I-3 Intrinsic Equations

All these quantities are connected by algebraic and differential relations which do not depend on the flow considered (these flows are described in the next section), which is what we call intrinsic equations. The other types of equation, mainly friction laws, are studied in the next section.

I-3-1 Algebraic Equations

We first express the relations directly obtained from the definition of the quantities.

$$q_G=\rho_G R_G V_G \quad (I.1)$$

$$q_L=\rho_L R_L V_L \quad (I.2)$$

$$R_G+R_L=1 \quad (I.3)$$

The perfect gas equation allows to establish the following relation between the pressure and the density of the gas:

$$\rho_G(x, t) = \frac{P(x, t)}{a^2} \quad (I.4)$$

In fact, $$a = \sqrt{\frac{R \times T}{M_g}}$$

or $M_g$ is the molar mass of the gas, T the temperature of the mixture and R the perfect gas constant, a corresponds to the sound velocity in the gas at 1 bar.

I-3-2 Differential Equations

The mass conservation of each phase imposes that:

$$\frac{\partial \rho_G R_G}{\partial t} + \frac{\partial q_G}{\partial x} = 0 \quad (I.5)$$

$$\frac{\partial \rho_L R_L}{\partial t} + \frac{\partial q_L}{\partial x} = 0 \quad (I.6)$$

The momentum conservation according to the previous hypotheses imposes that:

$$\frac{\partial P}{\partial x} = -g \sin\theta(R_G\rho_G + R_L\rho_L) - F_p \quad (I.7)$$

where θ is the inclination of the pipe, g the gravity constant and $F_p$ the wall friction (friction of the stream against the wall).

A closing equation is added to the aforementioned equations in form of an algebraic slippage law as follows: $\Psi(P, R_G, V_G, V_L, \rho_L)=0$.

I-4 Slippage Law

The selected slippage law Ψ depends on the flow regime. Three flow types can be considered: stratified flow, dispersed bubble (or simply bubble) flow and intermittent flow. All the flow regimes are illustrated in FIGS. 8A to 8E and 9A to 9G. For our study, we consider the case of an intermittent flow in the riser and of a stratified flow in the pipeline. We shall see hereafter that, considering possible simplifications, no slippage law is necessary for the stratified flow regime.

I-4-1 Intermittent Flow

This flow regime is due to a <<superposition>> between a bubble flow and a stratified flow. When the gas flow rate increases, the bubbles clump together and coalesce. Large shell-shaped bubbles appear. They are separated by liquid slugs which generally contain small gas bubbles.

Under such conditions, the friction law for an intermittent flow is expressed as follows:

$$V_G-C_0(R_G V_G+R_L V_L)-V_\infty=0 \quad (I.10)$$

hence function $\Psi_{int}$ ($V_G$, $V_L$, $R_L$, $V_{28}$).

Besides, $V_\infty$, is experimentally determined and has the following form:

$$V_\infty=(0.35 \sin\theta+0.54 \cos\theta)\sqrt{gD}$$

II Study of the Pipeline-Riser System Without Friction

In this part, we fix $F_p=0$ in Equation I.7 considering that the riser is vertical and that it is assumed that, in the flow disturbances observed, the frictions only have a limited influence in relation to the gravity. Solution of the equations is therefore a priori simplified.

II-1 Steady State in the Riser

In the case of a steady state, the various quantities only depend on the space; they are marked with a line to show that they are steady quantities. Furthermore, any constant function is asterisked. Thus, for example, under steady conditions, the liquid and gas flow rates $\overline{q}_L$ and $\overline{q}_G$ are constant. They are therefore denoted by $q_L^*$ and $q_G^*$. Besides, the pressure at the top of the riser is denoted by $P_o$.

Intermittent Flow

The closing equation is thus given by I.10. Furthermore, as before, in the steady state, the gas and liquid flow rates being constant, they are denoted in the same way.

The implicit formulation of $\overline{P}$ under intermittent flow conditions is written as follows:

$$g(\overline{P}(z))=g(P_0)-z \quad (II.15)$$

with g given by the relation:

$$g : x \to \frac{a^2 q_G^*(C_0(q_G^* + q_L^*) + \rho_L^* V_\infty)}{g(q_G^* + \rho_L^* V_\infty + C_0 q_L^*)^2} \ln\left[x - \frac{(1 - C_0)\rho_L^* a^2 q_G^*}{q_G^* + \rho_L^* V_\infty + C_0 q_L^*}\right] + \frac{\rho_L^* V_\infty + C_0 q_L^*}{g\rho_L^*(q_G^* + \rho_L^* V_\infty + C_0 q_L^*)} x$$

The pressure can be calculated in implicit form as for a steady flow regime under the assumption of an intermittent flow.

$\overline{P}$ (z) can thus be assumed to be known at least numerically. It is then possible to express all the other quantities as a function of P(z) and z. For the transient states, the steady quantities are assumed to be known.

II-2 Steady Model in the Pipeline

We a priori have the flow regime choice. However, practice shows that it is more rational to choose the stratified flow regime, or at a pinch the intermittent flow regime, knowing that the second one is less probable. The solution of the intermittent flow regime is similar to that of the previous section while not imposing $$\left(\theta = \frac{\pi}{2}\right)$$

in Equation 1–7. The system can once again be integrated. Assuming that the flow in the pipeline is stratified, the closing equation is too complicated to allow the equations to be solved. We therefore involve the pipeline only by the effect it has on the riser, i.e. by measuring the riser inlet quantities (flow rates, pressure, surface fractions) instead of determining them in relation to the calculated pipeline outlet quantities. The calculations are therefore replaced by riser inlet measurements.

II-3 Transient State in the Riser in the Tangent Linear Model

We develop hereafter the calculations about the steady state and linearize the intrinsic equations to the first order so as to simply solve the transient system.

II-3-1 Riemann Invariant

Introduction of this invariant allows to facilitate the pertinent solution of the equations in the tangent linear model. It is expressed in the form $$k = \frac{\rho_G R_G}{1 - C_0 R_G}$$

which has no evident physical significance. We thus have the following relation:

$$\forall\,(z, t) \in ]-H, 0[ \times R_+^*,\ \frac{\partial k}{\partial t} + V_G \frac{\partial k}{\partial z} = 0 \tag{II.28}$$

Quantity k moves in the riser, under intermittent flow conditions, at the velocity $V_G$.

Thus, the property of k allows us to assert that the propagation of k under intermittent conditions is expressed as follows:

$$k(z,t)=k(-H,t-T(z)), \tag{II.30}$$

with $$T(z) = \int_{-H}^{z} \frac{1}{V_G}\,dx$$

Quantity k at a height z of the riser has the same value as at the bottom of the riser T(z), one time unit α earlier.

With this Riemann invariant, we are going to express P'(−H,t), which is the pressure variation at the bottom of the riser where the disturbances start, as a function of the riser inflow rates. This can allow us to conceive a control over this pressure.

II-3-2 Transient Inflow-Outflow Laws Intermittent Flow Regime

We suppose here that the values of the steady quantities are given (these functions are known from the steady mode study). By applying the linearization techniques, we can establish the following result:

$$P'(z, t) = \overline{F}(z)\left[N_z * \left(q'_{G-H} - \frac{\overline{k}C_0}{\rho_L^*} q'_{L-H}\right)(t) + P'(-H, t)\right] \tag{II.31}$$

where $N_z$, $q'_{G-H}$, $q'_{L-H}$ are functions of t respectively obtained from N, $q'_G$, $q'_L$ where the first variable has been set at z, −H and −H respectively.

In fact, linearization of Equation I.7 gives:

$$\frac{\partial P'}{\partial z} = -g((\overline{\rho}_G - \rho_L^*)R'_G + \overline{R}_G \rho''_G)) \tag{II.32}$$

We are going to replace $R'_G$ by its expression as a function of P' and k'. We therefore note that $$k = \frac{\rho_G R_G}{(1 - C_0)R_G}.$$

By linearizing this relation, we obtain $$R'_G = \frac{k'(1 - C_0\overline{R}_G) - \rho'_G\overline{R}_G}{\overline{\rho}_G + C_0\overline{k}}.$$

Then, if we replace $R'_G$ in II.32 by this expression, we obtain the following differential equation:

$$\frac{\partial P'}{\partial z}(z, t) + \frac{g\,\overline{R}_G(C_0\overline{k} + \rho_L^*)}{a^2(\overline{\rho}_G + C_0\overline{k})} P'(z, t) = -\frac{g(\overline{\rho}_G - \rho_L^*)(1 - C_0\overline{R}_G)}{\overline{\rho}_G + C_0\overline{k}} k'(z, t) \tag{II.33}$$

The Riemann invariance property of k extends to k' in the following forms:

$$\frac{\partial k'}{\partial t} + \overline{V}_G \frac{\partial k'}{\partial z} = 0$$

and k'(z,t)=k'(−H,t−$\overline{T}$(z)) with $$\overline{T}(z) = \int_{-H}^{z} \frac{1}{\overline{V}_G}\,dx$$

We can therefore write:

$$\frac{\partial P'}{\partial z}(z, t) + \frac{g\,\overline{R}_G(C_0\overline{k} + \rho_L^*)}{a^2(\overline{\rho}_G + C_0\overline{k})} P'(z, t) = -\frac{g(\overline{\rho}_G - \rho_L^*)(1 - C_0\overline{R}_G)}{\overline{\rho}_G + C_0\overline{k}} k'(-H, t - \overline{T}(z))$$

Furthermore, we can calculate k' as a function of the flow rates, and we obtain:

$$k' = \frac{\overline{k}}{\overline{q}_G}\left(q'_G - \frac{\overline{k}C_0}{\rho_L^*} q'_L\right)$$

By injecting this relation into II.33, this equation becomes:

$$\frac{\partial P'}{\partial z}(z,t)+\frac{g\overline{R}_G(C_0\overline{k}+\rho_L^*)}{a^2(\overline{\rho}_G+C_0\overline{k})}P'(z,t)=-\frac{g(\overline{\rho}_G-\rho_L^*)(1-C_0\overline{R}_G)}{\overline{\rho}_G+C_0\overline{k}}\frac{\overline{k}}{\overline{q}_G}\left(q'_G(-H,t-\overline{T}(z))-\frac{\overline{k}C_0}{\rho_L^*}q'_L(-H,t-\overline{T}(z))\right) \quad \text{II.34}$$

We then put:

$$\overline{B}(z)=\frac{g\overline{R}_G(C_0\overline{k}+\rho_L^*)}{a^2(\overline{\rho}_G+C_0\overline{k})} \text{ and } \overline{C}(z)=-\frac{g(\overline{\rho}_G-\rho_L^*)(1-C_0\overline{R}_G)}{\overline{\rho}_G+C_0\overline{k}}\frac{\overline{k}}{\overline{q}_G}$$

This equation is then integrated by means of the constant variation method. We then obtain:

$$\frac{1}{\exp\int_{-H}^{z}-\overline{B}(x)dx}P'(z,t)=P'(-H,t)+\int_{-H}^{z}\left(\overline{C}(x)\left(q'_G(-H,t-\overline{T}(z))-\frac{\overline{k}C_0}{\rho_L^*}q'_L(-H,t-\overline{T}(z))\right)^{\exp\int_{-H}^{x}\overline{B}(u)du}\right)dx$$

Finally, we put:

$$M(v)=\overline{C}\circ T^{-1}(v)e\int_0^{T^{-1}(v)}\overline{B}(u)du\overline{V}_G\circ T^{-1}(v) \text{ and } \overline{F}(z)=e\int_{-H}^{z}-\overline{B}(x)dx \text{ then}$$

$$P'(z,t)=\overline{F}(z)\left(\int_0^{T(z)}M(v)\left(q'_G(-H,t-v)-\frac{\overline{k}C_0}{\rho_L^*}q_L^*(-H,t-v)\right)dv+P'(-H,t)\right)$$

and if we put $N(z,v)=1_{[0,T(z)]}(v)M(v)$ then:

$$P'(z,t)=\overline{F}(z)\left[N_z*\left(q'_{G-H}-\frac{\overline{k}C_0}{\rho_L^*}q^*_{L-H}\right)(t)+P'(-H,t)\right],$$

as we have seen above.

In these relations:

$q'_{G-H}$ is the mass flow rate variation with time of the gas phase in the circulating multiphase fluid at the foot of the riser, i.e. at the height −H in relation to the top of the riser;

$q'_{L-H}$ is the mass flow rate variation with time, at the same height, of the liquid phase in the multiphase fluid.

III Gas Injection Control

The action selected to correct the disturbances consists in controlling the pressure at the bottom of the riser. In fact, if this pressure remains close to a steady value, this means that the slugs do not form and that the gas is never really blocked. The action will thus concern the pressure P(−H,t) at the bottom of the riser.

III-1 Gas Lift Control

We assume that the outlet pressure is fixed and therefore that $P'_0=0$. Relation III.31 can thus be written as follows:

$$P'(-H,t)=-\left[N_0*\left(q'_{G-H}-\frac{C_0\overline{k}}{\rho_L^*}q'_{L-H}\right)\right](t) \quad \text{III-42}$$

It can immediately be seen that, if one of the two members of the convolution product is zero or very small, it is the same for P'(−H,t). Now, $N_0$ cannot be modified. There still is quantity $$\left(q'G_{-H}-\frac{C_0\overline{k}}{\rho\dot{L}}q'L_{-H}\right)(t),$$

homogeneous with a flow rate, that is denoted by Q(t).

The principle of the control mode according to the invention will essentially consist, at predetermined action intervals, in measuring at a time $t_1$ the above quantity in order to obtain a measurement $M(t_1)$, then, at the time $t_1+\Delta t$, in adding to $Q(t_1+\Delta t)$ the quantity $u(t_1+\Delta t)=-M(t_1)$, and so on. We thus have $\forall i \geqq 1$:

$$u(t_1+i\Delta t)=-M(t_1+(i-1)\Delta t)$$

$$Q(t_1+i\Delta t)=u(t_1+i\Delta t)+M(t_1+i\Delta t)$$

Of course, when $\Delta t\rightarrow 0$, it amounts to equating the second term of the convolution product to zero. Since it is physically not conceivable to have a control that sucks the gas in a two-phase mixture, we use a control such that:

$$u(t_1+i\Delta t)=\max(-M(t_1+(i-1)\Delta t),0).$$

IV Validation of Gas Injection Controls

To validate this control mode, we use the aforementioned TACITE code which simulates flows in the most accurate and realistic way possible.

We have studied two very different slug formation instances and tested our control mode thereon.

IV-1 Comments on Simulations

The TACITE software uses a finite-volume type method to simulate flows in pipes and the pipeline is discretized for example according to the gridding method described in patent application FR-EN-00/08,200 filed by the applicant. To simulate gas injection at the foot of the riser, we modify the flow between the two grid cells situated just before and just after the bend, respectively numbered n−1 and n. The initial state of our simulations is the steady flow regime. Coefficient $$\frac{C_0\overline{k}}{\rho_L}$$

is therefore measured once and for all at the initial time. We identify the steady flow rates with the pipeline inflow rates, and our riser inflow rates with the flow rates of grid cell n−1. To display the results, we approximate to the flow of gas to be injected by the flow rate difference between grid cells n and n−1.

IV-2 Simulations of Various Non-Controlled Cases

The simulations carried out by means of the TACITE simulation code are based on two geometries where L represents the length of the pipeline, H the height of the riser and ø their common diameter.

Case 1:L=60 m, H=14 m, ø=5 cm,

Case 2:L=1750 m, H=250 m, ø=25 cm.

Case 1:14-m riser

This is the case which we take as the reference:

$P_0$=1 bar, $Q_L$=2.10$^{-2}$ kg/s and $Q_G$=2.10$^{-4}$ kg/s. This case has marked oscillations, with an oscillation period of the order of one minute. The flow regime corresponds to our hypotheses: stratified in the pipeline and intermittent in the riser.

Figure 11A:
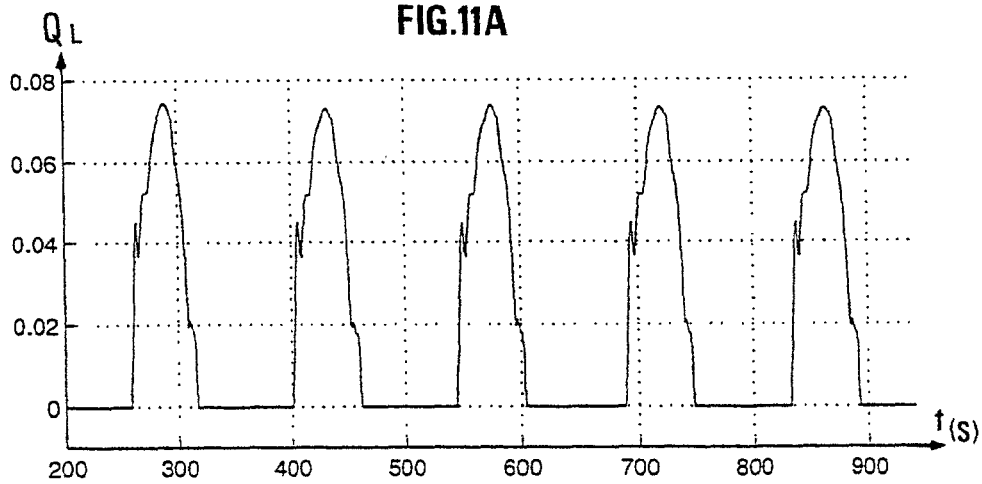
Figure 11B:
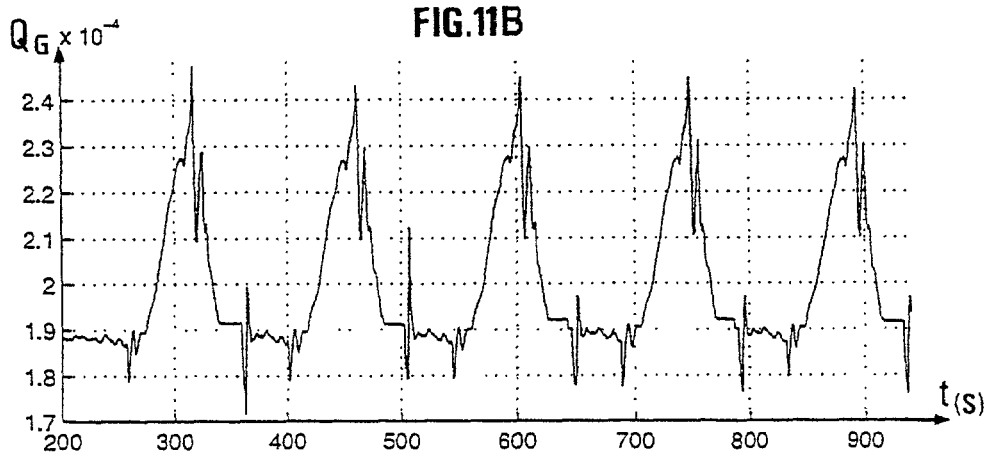
Figure 12:
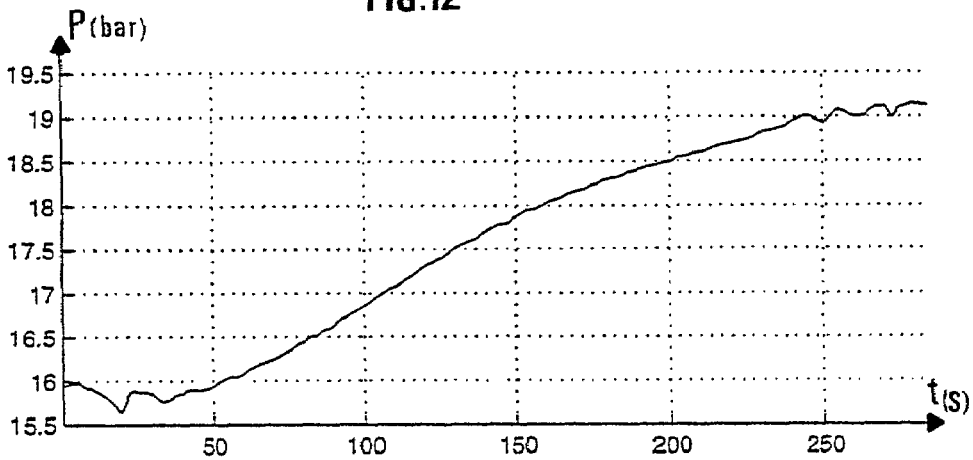
Figure 13A:
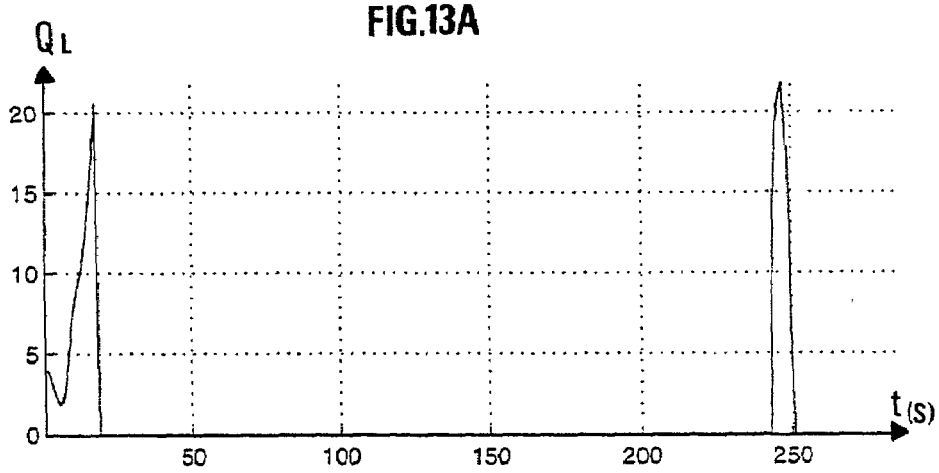
Figure 13B:
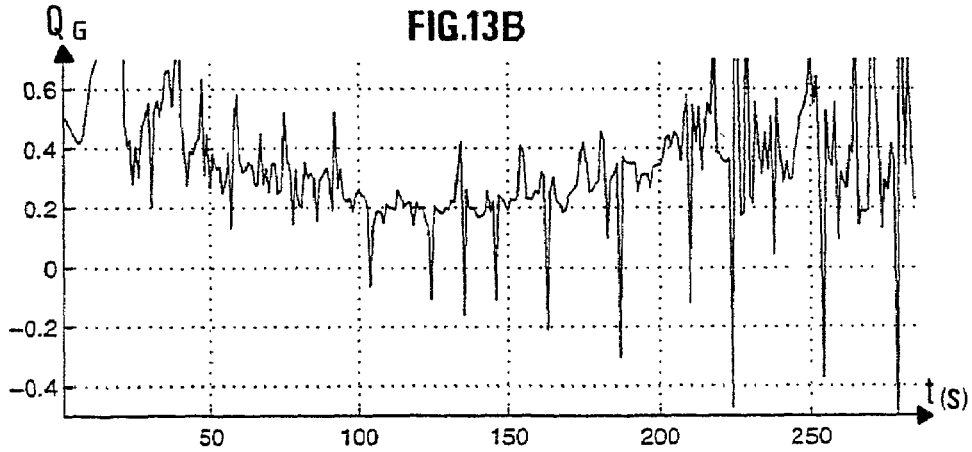

The oscillations of the system (FIGS. 11A, 11B) are not great enough to completely cancel out the flow of gas at the foot of the riser or for the free surface of the liquid to fall below the level of the mouth of the riser. We are therefore not in a situation of significant slug formation. This property allows to remain close to our tangent linearized hypothesis, while remaining in a flow regime that is not far from the steady state. We therefore remain, for any t, in the quasi-steady situation of transition towards slug formation.

Two main stages can be distinguished in the cycle:

1. A stage of accumulation of the liquid in the riser, the liquid flow rate is zero at the outlet and the pressure increases;
2. A stage of liquid slug production where the pressure decreases.

Case 2:250-m riser

The main characteristics of this case are as follows:

$P_0$=10 bar, $Q_L$=4 kg/s and $Q_G$=0.5 kg/s.

These conditions are closer to the real operating conditions of a pipeline. In the absence of any control the system enters into a liquid slug formation stage. It can be observed that the liquid flow rate at the outlet goes through already violent expulsion stages, even before the slug expulsion and pressure fall stage. At the end of the simulation, the pressure has reached a maximum value, and the system is about to enter into the liquid slug expulsion stage. The system is therefore in the phase of transition to slug formation only during the first moments, because the starting point of the simulation is the steady state.

Figure 14:
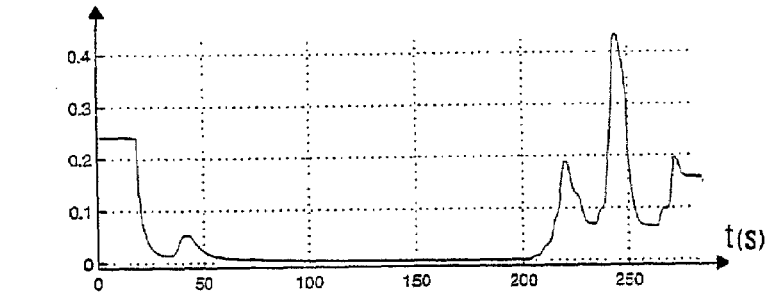
FIG. 14 shows the evolution of the volume fraction of liquid at the riser outlet, without control, FIG. 15 respectively shows an example of variation of the pressure at the foot of the 14-m high riser before gas injection and the stabilization obtained by controlled injection according to the method (from 500 s), FIGS. 16A and 16B respectively show, in the same riser, the curves of the variation with time of the liquid flow rate and of the gas flow rate, before and after control (also from 500 s)

FIG. 14 shows very fast cycles in the evolution of the liquid fraction. This is a sign of high instability in this case.

IV-3 Control of Both Cases

The first control that we are going to study is the theoretical control found in the previous chapter. Following our observations, we shall see that it is possible to conceive another control, that we are also going to test.

IV-3-1 Theoretical Control Test

We introduce here a control by gas lift by injecting, at the foot of the riser, a flow of gas of the following form:

$$u(t) = \max\left(0, \left(q'_{G_H} - \frac{C_0\bar{k}}{\rho_L^*} q'_{L_H}\right)(t - \Delta t)\right)$$

Case 1:14-m riser

We start control just before t=500 s. The graphs of FIGS.IV-16, IV-17 show in parallel the evolution of the free system (thick line) and that of the controlled system (fine dotted line). This control allows to maintain the pressure and the outlet flow rates close to their steady value. The mass of gas injected is small in relation to what comes from the pipeline; the outlet flow rate increase due to the injection of gas is less than 5%.

Case 2:250-m riser

Figure 16A:
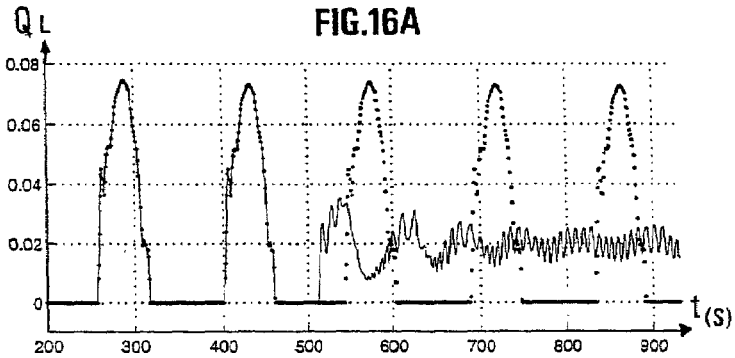
Figure 16B:
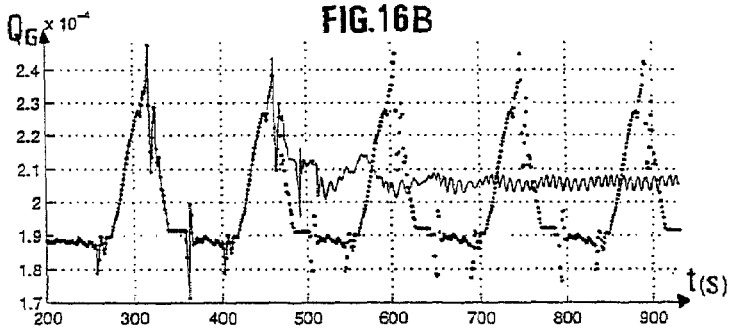
Figure 15:
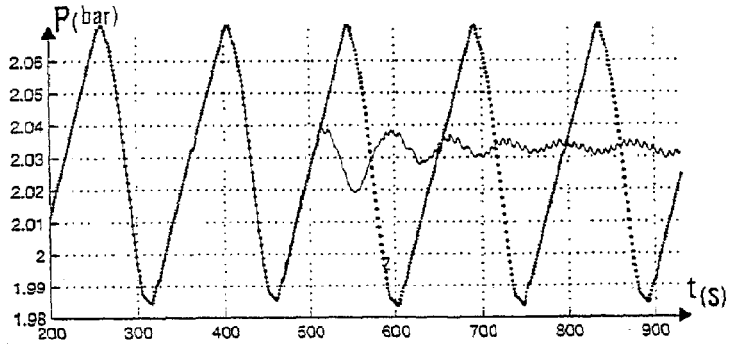

For this simulation, we start control from t=0 s. The graphs of FIGS. 15 and 16A, 16B show in parallel the evolution of the free system (thick line) and that of the controlled system (fine dotted line). The gas flow rates in the presence of control are much more regular than in the previous case.

Control by gas injection using the theoretical formula thus functions in both cases, although they are very different.

IV-3-2 Simplified Control

Since a great correlation is observed between the evolutions of the gas and liquid flow rates, and since we almost always have $$\left|q'_{G_H}\right| > \left|\frac{C_0\bar{k}}{\rho_L^*} q'_{L_H}\right|,$$

it is also possible to control the system with the simplified control:

$$u(t)=\max(0,(q'_{G_H})(t-\Delta t))$$

Case 1:14-m riser

Figure 17:
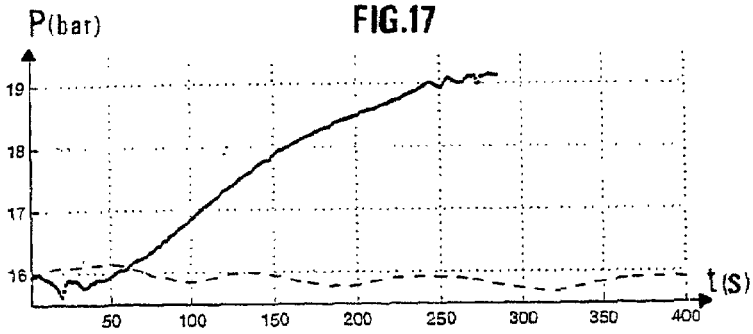
FIG. 17 shows, in a 250-m high riser, the pressure variation with time at the foot of the riser, without control (thick line) and with control (dotted line), FIGS. 18A, 18B respectively show, in the same riser, the liquid and gas pressure variations with time, without control (thick line) and with control (dotted line)
Figure 18A:
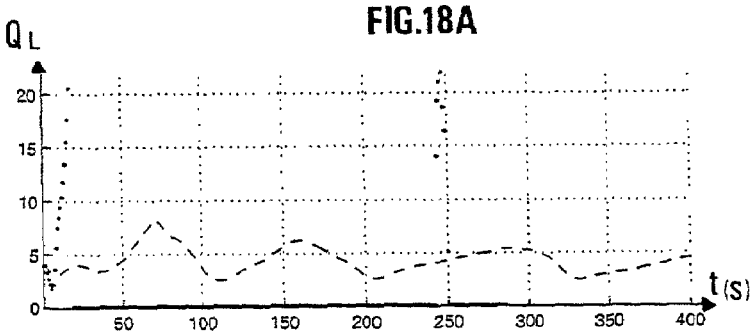
Figure 18B:
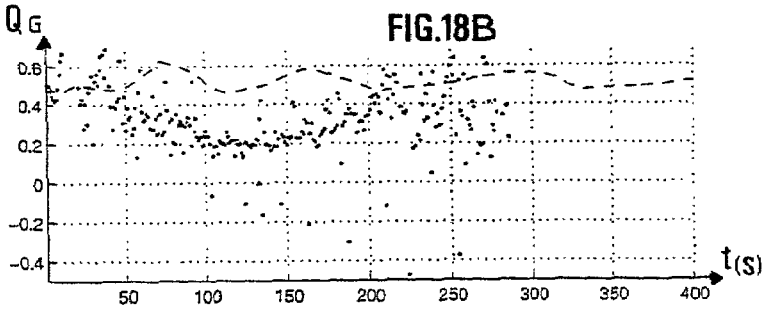
Figure 19:
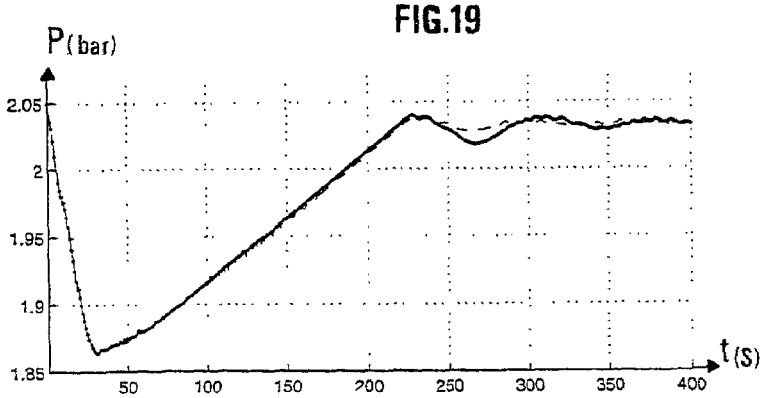
FIG. 19 shows the compared evolutions of the pressure at the foot of a 14-m riser with control of the injection pressure as a function of $q_G$ and $q_L$ (full line) and only of $q_G$ (dotted line), FIGS. 20A, 20B respectively show, in the same riser, the liquid and gas flow rate variations with time, with control of the injection pressure as a function of $q_G$ and $q_L$ (dotted line) and only of $q_G$ (full line)
Figure 20:
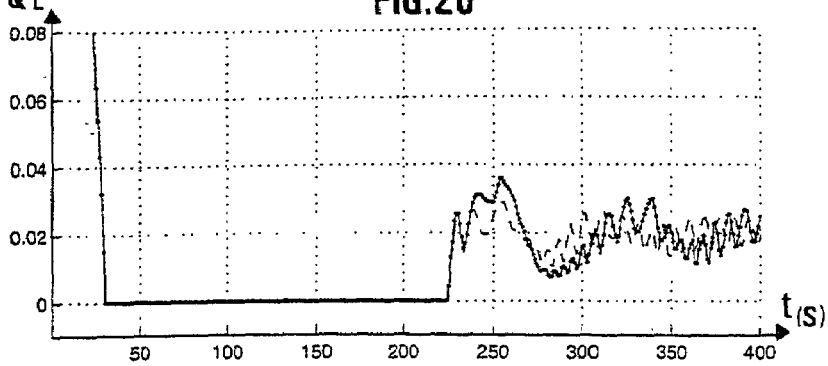
Figure 21:
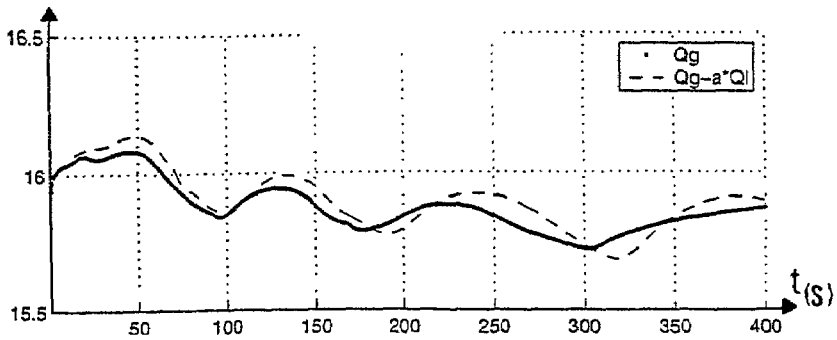
FIG. 21 shows, in a 250-m high riser, the pressure variations with time at the foot of the riser, with control of the injection pressure as a function of $q_G$ and $q_L$ (dotted line) and only of $q_G$ (full line), FIGS. 22A, 22B respectively show, in the same riser, the liquid and gas pressure variations with time, with control of the injection pressure as a function of $q_G$ and $q_L$ (dotted line) and only of $q_G$ (full line), FIGS. 23A, 23B respectively show the respective liquid and gas flow rate variations with time at the riser outlet, and FIG. 24 diagrammatically shows an embodiment of the device for implementing the method, allowing the formation of slugs to be neutralized.

In the graphs of FIGS. 17, 18A, 18B, control with $q_G$ and $q_L$ is shown with a thick line, whereas control with $q_G$ only is shown in fine dotted line. Control starts from t=0 s.

The results of the control concerning only $q_G$ are practically identical to those obtained with the control already tested, or even slightly better as regards the pressure oscillations and the control speed.

Case 2:250-m riser

Figure 22A:
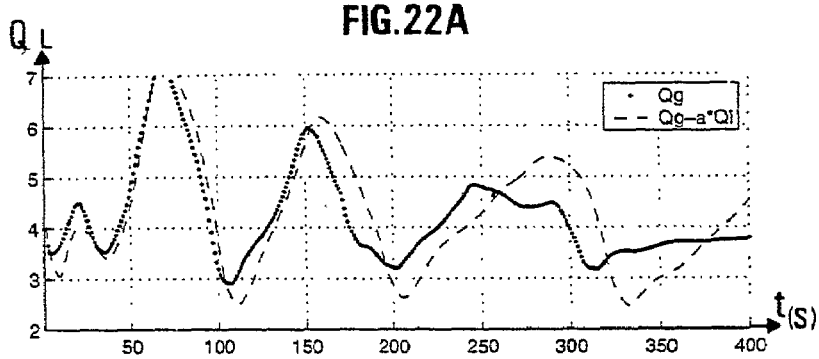
Figure 22B:
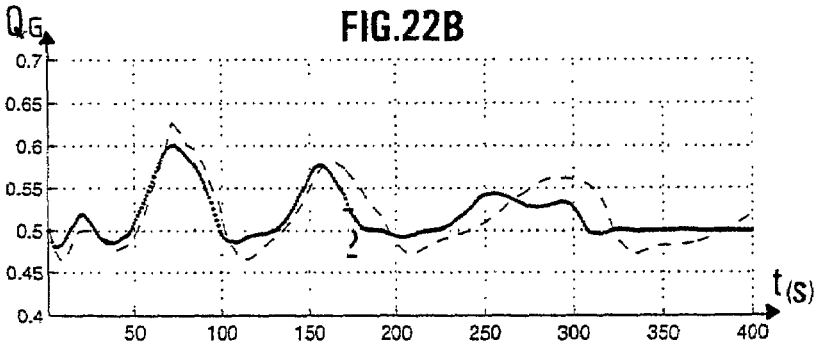

In this distinctly more unstable case, we observe (FIGS. 22A, 22B) no fast oscillations of the gas flow rate with the simplified control The system controlled with $q_G$ evolves with a slight lead in relation to the same case controlled with the complete expression.

We can therefore see that the simplified control without coefficient $q_L$ also allows to control the system, but the theoretical control is better because, unlike the simplified control, it does not lead to problems at the riser outlet, it is more economical as regards injection gas and the system is controlled just as well.

IV-3-3 Control Robustness

We test the robustness of our theoretical control ($q_G$ and $q_L$) in relation to the reaction time of the sensors and of the actuators. We therefore compare the control obtained above by adjusting the gas flow rate at each time interval (thick dotted line) with the control obtained by adjusting these parameters with a lower frequency (fine dotted line).

Case 1:14-m riser

Control is readjusted every 3 seconds here, which corresponds to 20 time intervals for TACITE. Control starts from t=0 s.

Figure 23A:
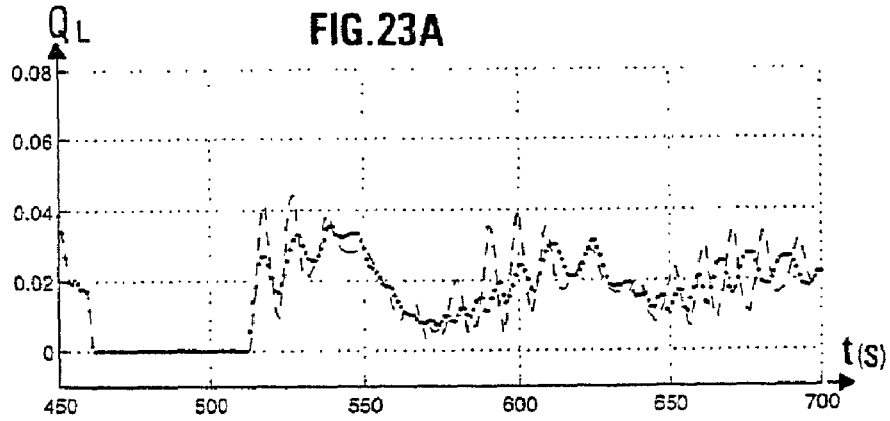
Figure 23B:
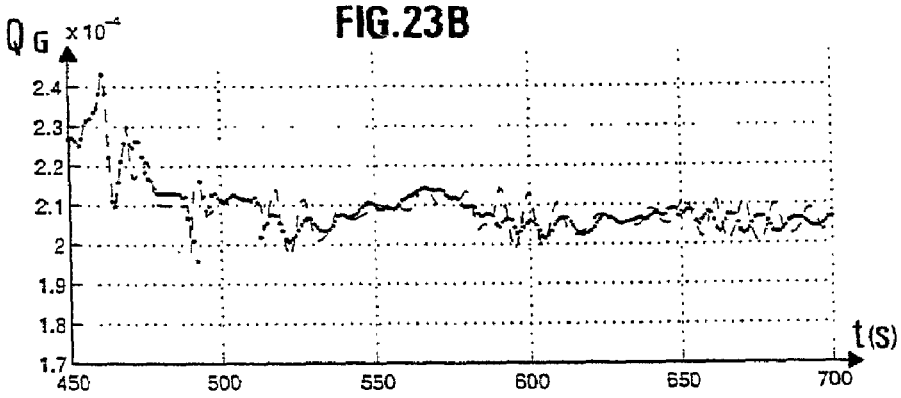

It can be seen in FIGS. 23A, 23B that the flow rates are a little more irregular, but the system is still controlled.

Case 2:250-m riser

The system is not stabilized with a 2-second time constant. With a 1-second time constant, the system is stabilized but we remain close to the order of magnitude of the calculating interval (about 0.3 s in this case). Furthermore, there is practically no difference with the case where control is adjusted at each time interval.

In any case, we have a good control even though the flow rates oscillate very slightly around a mean value.

Figure 24:
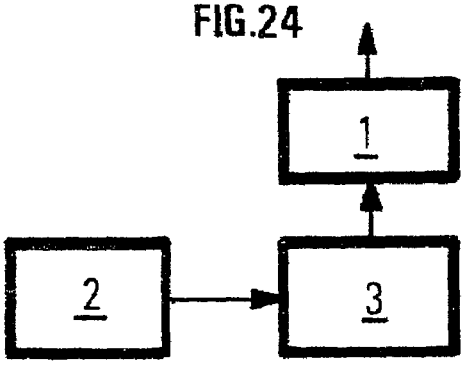

The device for implementing the method comprises (FIG. 24) gas injection means 1 connected to the base of the riser, means 2 for measuring the flow rate of the gas phase of the circulating fluids, and a computer 3 intended to control injection, through injection means 1, of a volume of gas proportional to and preferably substantially close to the flow rate variation with time of the gas phase of the circulating fluids, when this variation is positive.

The invention claimed is:

1. A method for neutralizing, by controlled gas injection, liquid slug formation or accumulation at the foot of a pipe portion greatly inclined to the horizontal or riser connected to a pipe carrying circulating multiphase fluids, comprising:

measuring, at the bottom of the riser, the flow rate variation with time of the gas phase of the circulating fluids; and injecting, at the base of the riser, a volume of gas substantially proportional to the flow rate variation with time of the gas phase of the circulating fluids, when this variation is positive.

2. A method as claimed in claim 1, characterized in that the injected volume of gas is substantially equal to the flow rate variation with time of the gas phase of the circulating fluids.

3. A method as claimed in claim 2, characterized in that said injected volume of gas is modulated by a quantity proportional to the flow rate variation of the liquid phase of the circulating fluids.

4. A method as claimed in claim 2, characterized in that the flow rate variation with time of the gas phase of the circulating fluids, measured at a previous time interval, is injected at a time t.

5. A method as claimed in claim 1, characterized in that said injected volume of gas is modulated by a quantity proportional to the flow rate variation of the liquid phase of the circulating fluids.

6. A method as claimed in claim 1, characterized in that the flow rate variation with time of the gas phase of the circulating fluids, measured at a previous time interval, is injected at a time t.

7. A device for neutralizing, by controlled gas injection, liquid slug formation or accumulation at the foot of a pipe portion greatly inclined to the horizontal or riser connected to a pipe carrying circulating multiphase fluids, comprising gas injection means connected to the base of the riser, means for measuring the flow rate of the gas phase of the circulating fluids and a computer intended to control injection, by the injection means, of a volume of gas substantially proportional to the flow rate variation with time of the gas phase of the circulating fluids, when this variation is positive.

8. A device as claimed in claim 7, characterized in that the computer is suited to control injection, by the injection means, of a volume of gas substantially equal to the flow rate variation with time of the gas phase of the circulating fluids.

9. A device as claimed in claim 8, comprising means for measuring the flow rate of the liquid phase circulating in the pipe, the computer being suited to modulate the injected volume of gas by a quantity proportional to the measured flow rate variation of the liquid phase.

10. A device as claimed in claim 7, comprising means for measuring the flow rate of the liquid phase circulating in the pipe, the computer being suited to modulate the injected volume of gas by a quantity proportional to the measured flow rate variation of the liquid phase.

* * * * *